United States Patent [19]

Hamai et al.

[11] 4,354,136

[45] Oct. 12, 1982

[54] IGNITION PLUG FOR INTERNAL COMBUSTION ENGINE

[75] Inventors: Kyugo Hamai, Yokosuka; Meroji Nakai, Yokosuka; Ryuzaburo Maruyama, Fujisawa; Yasuhiko Nakagawa, Kamakura, all of Japan

[73] Assignee: Nissan Motor Company, Limited, Yokohama, Japan

[21] Appl. No.: 123,690

[22] Filed: Feb. 22, 1980

[30] Foreign Application Priority Data

Mar. 8, 1979 [JP] Japan ..... 54-27132
Nov. 5, 1979 [JP] Japan ..... 54-153557[U]

[51] Int. Cl.[3] ..... H01T 13/20
[52] U.S. Cl. ..... 313/139; 313/143
[58] Field of Search ..... 313/143, 139

[56] References Cited

U.S. PATENT DOCUMENTS

| | | | |
|---|---|---|---|
| 1,952,343 | 3/1934 | Watts | 313/139 X |
| 2,171,164 | 8/1939 | Rabezzana | 313/139 X |
| 2,205,196 | 6/1940 | Harper, Jr. | 313/143 X |
| 2,208,030 | 7/1940 | Holmes | 313/143 X |
| 2,489,410 | 11/1949 | Hahn | 313/143 X |
| 2,586,864 | 2/1952 | Rose | 313/139 X |
| 2,899,585 | 8/1959 | Dollenberg | 313/143 |
| 3,958,144 | 5/1976 | Franks | 313/138 |
| 4,028,576 | 6/1977 | Wofsey | 313/143 |

FOREIGN PATENT DOCUMENTS

| | | | |
|---|---|---|---|
| 465433 | 6/1946 | Belgium . | |
| 823299 | 1/1938 | France | 313/139 |
| 1035735 | 8/1953 | France . | |
| 1326022 | 3/1963 | France . | |
| 54/13844 | 2/1979 | Japan | 313/139 |
| 686496 | 1/1953 | United Kingdom . | |
| 850402 | 10/1960 | United Kingdom | 313/139 |
| 906620 | 9/1962 | United Kingdom . | |
| 1005767 | 9/1965 | United Kingdom . | |
| 1127187 | 9/1968 | United Kingdom . | |
| 1370761 | 10/1974 | United Kingdom . | |
| 1373435 | 11/1974 | United Kingdom . | |
| 1521313 | 8/1978 | United Kingdom . | |

*Primary Examiner*—Palmer C. Demeo
*Attorney, Agent, or Firm*—Thompson, Birch, Gauthier & Samuels

[57] ABSTRACT

An ignition plug for an internal combustion engine is disclosed which comprises an elongate electrode means inserted at the center of a plug body, another cylindrical electrode means encircling the electrode means and an insulator means provided between the elongate and cylindrical electrode means and forming a small cavity which is in communication with a combustion chamber. A plasma gas is created in the cavity due to the generation of a spark between the elongate and cylindrical electrode means and is jetted into the combustion chamber to ignite the air-fuel mixture therein. A gap into which the burnt gas is introduced is formed between the insulator means and the cylindrical electrode means so as to warm the wall of the cavity and thereby avoid ignition misfiring.

9 Claims, 15 Drawing Figures

IGNITION PLUG FOR INTERNAL COMBUSTION ENGINE

BACKGROUND OF THE INVENTION

The present invention relates to an ignition plug for an internal combustion engine of an automobile. More specifically, the invention relates to an improvement in the structure of an ignition plug for an internal combustion engine of an automobile of a type to jet a flow of plasma gas caused by a generation of a spark between an inner electrode and an outer electrode into a combustion chamber so as to ignite an air-fuel mixture therein.

In order to enhance the efficiency of an internal combustion engine, in particular a gasoline engine, it is important to insure effective fuel ignition. Effective ignition is also an important means of satisfying the strict governmental regulations which have been imposed on the permissible levels of noxious substances contained in exhaust gases. However, in systems designed to burn thin air-fuel mixtures or in exhaust gas recirculation (EGR) systems, it becomes much more difficult to achieve effective ignition. Various attempts have been made at doing so. An example of one of such attempt is shown in FIG. 1 where in an ignition plug 1, an elongate electrode 2 is inserted at the center of a plug body. Reference numeral 3 denotes another cylindrical electrode which forms a part of the plug body in such a way as to encircle the elongate electrode 2. An insulator 4 such as ceramic or the like is provided in the plug body in such a way as to support the elongate electrode 2 and form a small cavity 5 at an end portion thereof. The cavity 5 is in communication with a combustion chamber by way of an opening 6 formed in the closed end wall of the cylindrical electrode 3.

In this ignition plug 1, a spark is generated between the elongate electrode 2 and the plug body 3 forming a cylindrical electrode, thereby creative a plasma gas of a high temperature and energy in the small cavity 5. The plasma gas thus created in the cavity 5 is jetted therefrom into the combustion chamber as a result of the pressure in the cavity 5 increasing due to thermal expansion of the plasma gas. The jetting plasma gas flow of a high temperature and energy brings about many flame cores in the air-fuel mixture in the combustion chamber, thereby ensuring the ignition without fail. In this ignition plug 1, however, there is a defect in that fuel, carbon, engine oil or the like can coat the inner wall of the cavity 5. When this occurs, a spark is not generated properly in the cavity 5, and a misfire results.

Another defect associated with the ignition plug 1 lies in the fact that the force of the plasma gas jet emerging from the cavity 5 is dependent solely on thermal gas expansion within the cavity.

SUMMARY OF THE INVENTION

With the above in mind, an object of the present invention is to provide an ignition plug for an internal combustion engine of an automobile which avoids misfiring by introducing the burnt gas in the combustion chamber into the ignition plug so as to warm the wall of the cavity in which the plasma gas is generated.

Another object of the present invention is to provide an ignition plug for an internal combustion engine of an automobile which enhances the jetting efficiency of the plasma gas by the function of the electromagnetic force induced by the discharge electric current between the inner electrode and the outer electrode.

According to the present invention, there is provided an ignition plug for an internal combustion engine of an automobile of a type to generate a plasma gas and jet the same into a combustion chamber wherein a gap is formed between an insulator means and a cylindrical electrode means and at least one opening is formed in the closed end wall of the cylindrical electrode means so as to introduce the burnt gas in the combustion chamber into the gap between the insulator means and the cylindrical electrode means, thereby warming the wall of the cavity and insuring proper ignition.

BRIEF DESCRIPTION OF THE DRAWINGS

The features and advantages of an ignition plug for an internal combustion engine of an automobile in accordance with the present invention will become apparent from the following description taken in conjunction with the accompanying drawings, in which.

In all the drawings, the same reference numeral indicates the same or a corresponding element.

DETAILED DESCRIPTION OF THE PRESENT INVENTION

The present invention will now be described in terms of preferred embodiments, and with reference to FIG. 2 through FIG. 15.

Figure 1:
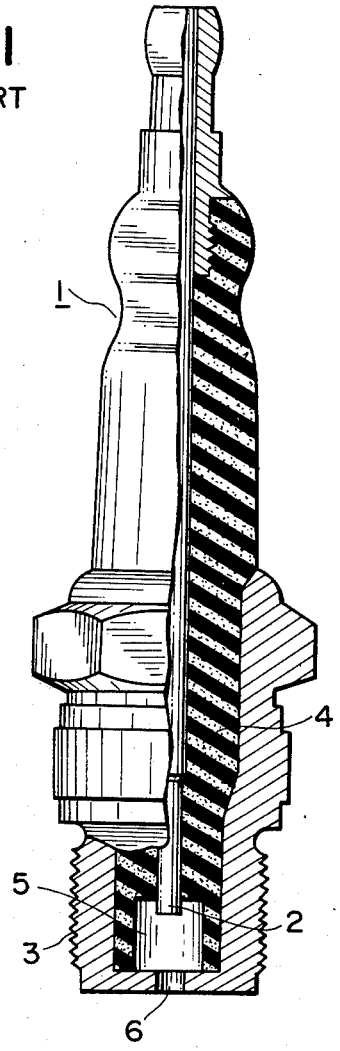
FIG. 1 PRIOR ART
FIG. 1 is a side elevationview, which is partly shown in cross-section, of an ignition plug for an internal combustion engine of an automobile in accordance with the prior art.
Figure 2:
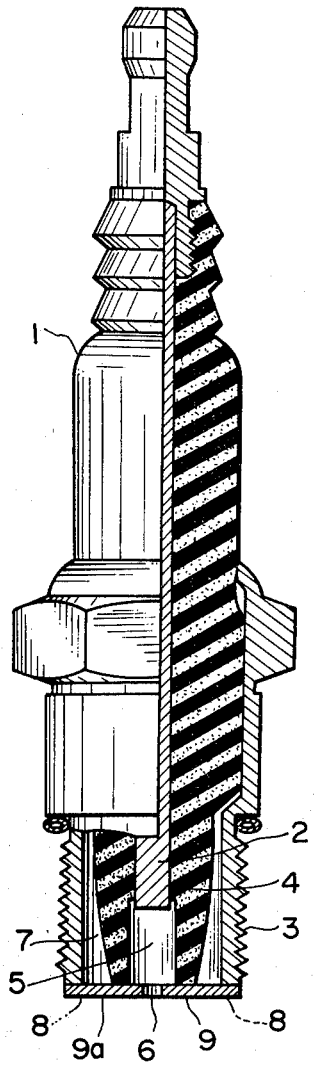
FIG. 2 is a side elevation view, which is partly shown in cross-section, of an ignition plug for an internal combustion engine of an automobile in accordance with one embodiment of the present invention.
Figure 3:
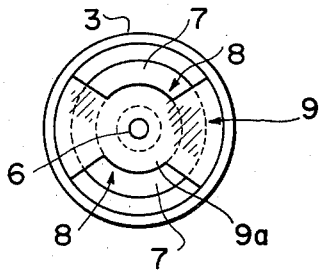
FIG. 3 is a bottom plan view of FIG. 2.

In the ignition plug 1 shown in FIG. 2, an annular gap 7 which is widened towards the combustion is formed between the insulator 4 and the plug body 3. Grooves 8, 8 through which the gap 7 communicates with the combustion chamber are formed in the electrode 9 attached to the plug body 3. The outer surface of the plug body 3 is threaded in such a way that the bridge portion 9*a* conforms smoothly to the inner wall of the combustion chamber in which the ignition plug 1 is mounted. The constitution and function other than mentioned now are identical with those mentioned with reference to the ignition plug shown in FIG. 1 and therefore the explanation thereof will be omitted here.

In the ignition plug 1 in FIG. 2 which is constituted as mentioned above, the burnt gas in the combustion chamber is effectively introduced into the annular gap 7 by way of the grooves 8, 8, thereby the wall portion of the cavity 5 in which the plasma gas is generated is warmed. As the consequence, the fuel, carbon, engine oil or the like does not adhere to the inner wall of the cavity and thus the occurrence of misfiring is effectively prevented.

Figure 4:
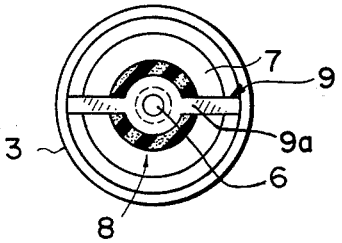
FIG. 4 is a bottom plan view of another embodiment in accordance with the present invention.
Figure 5:
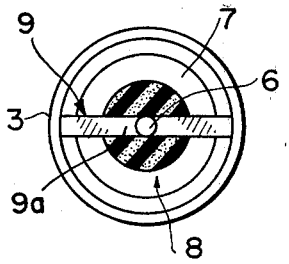
FIG. 5 is a bottom plan view of still another embodiment in accordance with the present invention.
Figure 6:
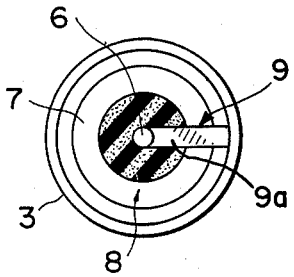
FIG. 6 is a bottom plan view of still another embodiment in accordance with the present invention.

In the embodiments shown in FIG. 4 through FIG. 6, the area of the grooves 8, 8 formed in the electrode 9 is increased so as to facilitate the introduction of the burnt gas from the combustion chamber into the annular gap 7. In addition, in the embodiments of FIGS. 5 and 6, the inner diameter of the cavity 5 is made equal to that of the opening 6 by way of which the plasma gas in the cavity 5 is jetted into the combustion chamber.

Figure 7:
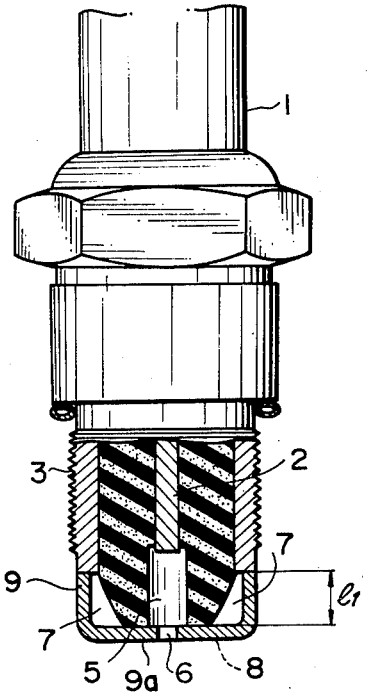
FIG. 7 is a side elevation view, which is partly shown in cross-section, of an ignition plug of still another embodiment in accordance with the present invention.
Figure 8:
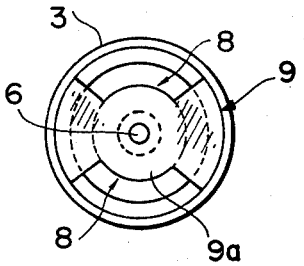
FIG. 8 is a bottom plan view of FIG. 7.

In the embodiment shown in FIG. 7 and FIG. 8, the electrode 9 is projected by a length $l_1$ from the inner wall of the combustion chamber into the combustion chamber. By so doing, the introduction of the burnt gas from the combustion chamber into the annular gap 7 becomes more effective.

Figure 9:
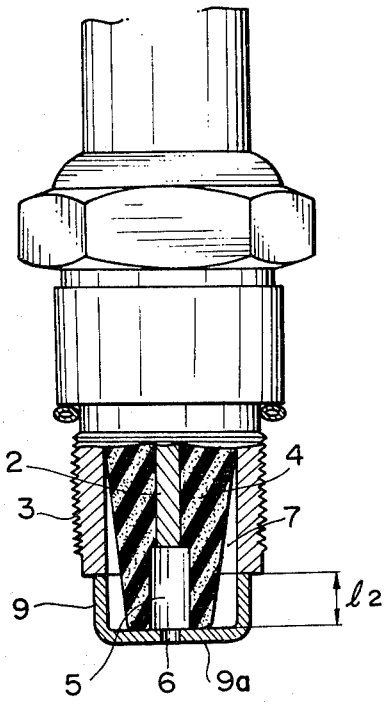
FIG. 9 is a side elevation view of an ignition plug of still another embodiment in accordance with the present invention.
Figure 10:
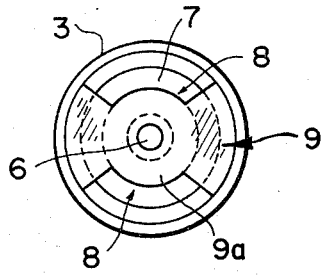
FIG. 10 is a bottom plan view of FIG. 9.

In the embodiment shown in FIG. 9 and FIG. 10, the annular gap 7 is lengthened lengthwise in comparison with the embodiment shown in FIG. 7, so as to present a wedge shape in cross section, and the electrode 9 is projected by a length $l_2$ from the inner wall of the combustion chamber into the combustion chamber. By so doing, the burnt gas introduced into the annular gap 7 surrounds the wall of the cavity 5 more effectively.

Figure 11:
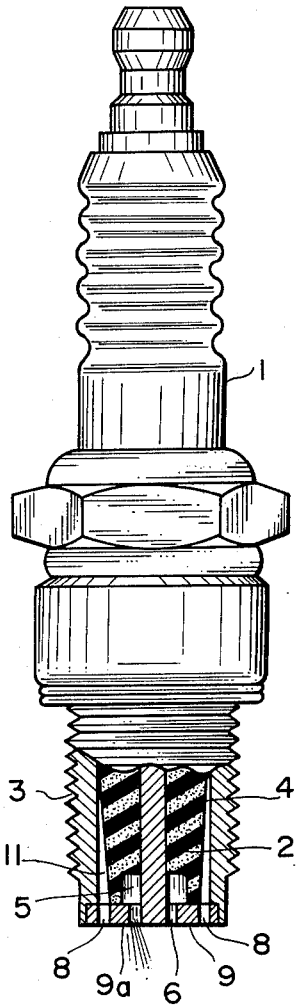
FIG. 11 is a side elevation view, which is shown partly in cross-section, of an ignition plug of still another embodiment in accordance with the present invention.
Figure 12:
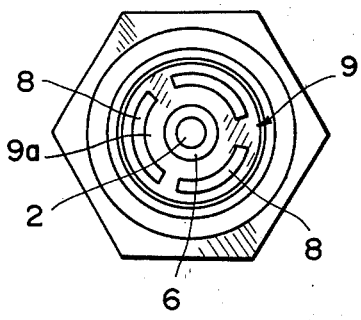
FIG. 12 is a bottom plan view of FIG. 11.

In the embodiment shown in FIG. 11 and FIG. 12, the elongate electrode 2 is extended to the bridge portion 9*a* of the electrode 9, and an annular opening 6 around the end portion of the elongate electrode is formed in the electrode 9.

In this embodiment, if an electric current for ignition of a high energy flows between the electrodes 9 and 2 by way of the annular opening 6, a strong electromagnetic force functions which is directed towards the combustion chamber, and at the same time, a sufficient amount of plasma gas is generated in the cavity 5 due to the existence of air-fuel mixture therein.

The strong electromagnetic force which is functioning in the direction towards the combustion chamber accelerates the flow of plasma gas which is jetted through the annular opening 6 due to the increase of pressure in the cavity 5 as the result of thermal expansion in the cavity 5. Thus, the electromagnetic force induced by the discharge of an electric current between both the electrodes and the increase of pressure in the cavity 5 due to thermal expansion function in a multiplying manner, thereby powerful flame cores are formed in the air-fuel mixture in the combustion chamber, so as to ensure a reliable ignition.

In addition, there is another advantage in this embodiment in that the igniting position is stable because the opening 6 through which the plasma gas is jetted from the cavity 5 towards the combustion chamber is formed around the end portion of the elongate electrode 2 in such a way as to present a narrow annular configuration.

Figure 13:
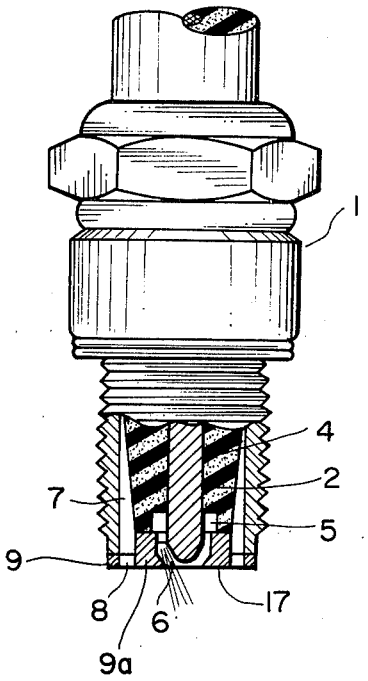
FIG. 13 is a side elevation view, which is shown partly in cross-section, of an ignition plug of still another embodiment in accordance with the present invention.
Figure 14:
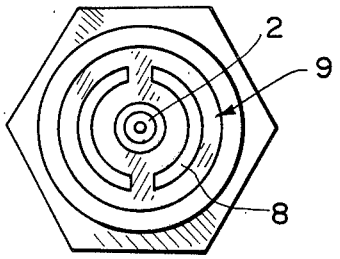
FIG. 14 is a bottom plan view of FIG. 13.

In the embodiment shown in FIG. 13 and FIG. 14 which is the improvement of the embodiment shown in FIG. 11 and FIG. 12, the end portion of the elongate electrode 2 is shaped conically and the outer periphery of the opening 6 is shaped in such a way as to be in parallel with the conical configuration of the end portion of the elongate electrode 2. By so doing, it has been confirmed that the electromagnetic force induced by the discharge of the electric current between both the electrodes is increased, so as to more effectively accelerate the flow of plasma gas.

Figure 15:
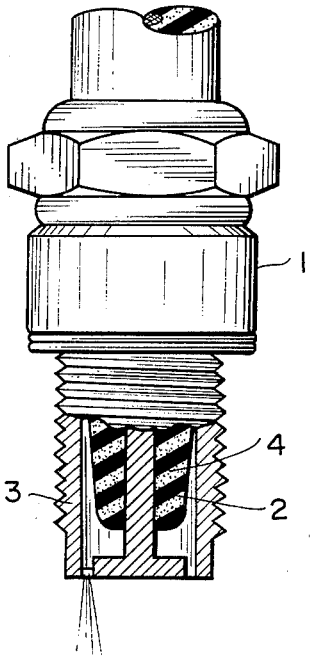
FIG. 15 is a side elevation view, which is shown partly in cross-section, of an ignition plug of still another embodiment in accordance with the present invention.

In addition to the embodiments as mentioned above, for example, the structure as shown in FIG. 15 is also possible without departing from the scope of the present invention.

In the ignition plugs as mentioned above, the wave noise is apt to occur due to the high energy discharge at the time when the plasma gas is generated and jetted. Therefore, it is desirable that a suitable shielding member is mounted to the ignition plug so as to suppress the radiation of such wave noise.

As will be clear from the foregoing description, an ignition plug for an internal combustion engine of an automobile of a type to generate a plasma gas and jet the same into a combustion chamber is constituted in accordance with one aspect of the invention in such a way that a gap is formed between the insulator means and the cylindrical electrode means and at least one opening is formed in the closed end wall of the cylindrical electrode means. Accordingly, the burnt gas in the combustion chamber is introduced into the gap between the insulator means and the cylindrical electrode means, thereby preventing the wall of the cavity in which the plasma gas is generated from being cooled and avoiding from the occurrence of misfiring in the ignition.

In accordance with another aspect of the invention, the elongate electrode means extends to the end surface of the bridge portion of the electrode extending from the plug body, and a small annular groove around the end portion of the elongate electrode means is formed in the bridge portion, thereby the electromagnetic force induced by the discharge of an electric current between both the electrodes and the increase of pressure in the cavity in which the plasma gas is generated due to thermal expansion function in a multiplying manner, so as to accelerate the jetting plasma gas flow.

While the present invention has been described in terms of perferred embodiments, and with reference to the drawings, this is not to be taken as limitative of the present invention which is rather to be defined by the appended claims.

What is claimed is:

1. An ignition plug for an internal combustion engine comprising:

an electrically conductive plug body having a threaded portion for engagement with an engine cylinder head;

an insulting member received in said plug body at the lower portion thereof and extending upwardly therefrom;

a first elongated electrode extending through said insulating member along the longitudinal axis thereof;

first means, incorporated in said insulating member, for defining a plasma generating chamber at the lower end of said insulating member, to which plasma generating chamber the lower end of said first elongated electrode is exposed;

second means, incorporated in said plug body, for cooperating with said insulating member in defining an annular hollow chamber between the internal periphery of said plug body and the outer periphery of said insulating member, said annular hollow chamber surrounding said plasma generating chamber;

a second electrode mounted at the lower end of said plug body in spaced relationship to said lower end of said first elongated electrode;

third means, incorporated in said second electrode, for establishing communication between said plasma generating chamber and the exterior of said plug; and fourth means, incorporated in said second electrode, for establishing communication between said annular hollow chamber and the exterior of said plug.

2. A plasma ignition plug for an internal combustion engine comprising:

an electrically conductive plug body having a threaded portion for fixedly mounting said plug body onto an engine cylinder head;

an insulating member received in said plug body at the lower portion thereof and extending upwardly from said plug body;

a first elongated electrode extending through said insulating member along the longitudinal axis thereof;

first means, incorporated in said insulating member, for defining a plasma generating chamber at the lower end of said insulating member, to which plasma generating chamber the lower end of said first elongated electrode is exposed;

second means, incorporated in said plug body, for cooperating with said insulating member in defining an annular hollow chamber between the internal periphery of said plug body and the outer periphery of said insulating member, said annular hollow chamber being separate from and surrounding said plasma generating chamber;

a second electrode fitted onto the lower end of said plug body in spaced relationship relative to said first elongated electrode so that initial spark ignition for producing a plasma gas can take place within said plasma generating chamber;

third means, incorporated in said second electrode, for permitting communication between the inside and outside of said plasma generating chamber; and fourth means, incorporated in said second electrode, for permitting communication between the inside and outside of said annular hollow chamber.

3. The plug as set forth in either claim 1 or 2, wherein said second electrode includes an annular portion fixed to the lower end of said plug body and a bridge portion extending over said plasma generating chamber, said bridge portion being formed with through openings acting as said third and fourth means.

4. The plug as set forth in either claim 1 or 2, wherein said fourth means is a cut-out formed in said second electrode at a location opposite to said annular hollow chamber.

5. The plug as set forth in either claim 1 or 2, wherein the first elongated electrode and said second electrode are co-related so that they induce an electromagnetic force for boosting discharge of the plasma gas produced within said plasma generating chamber from said plasma generating chamber.

6. A plasma ignition plug for an internal combustion engine comprising:

a plug body;

an insulting member having an axially extending through opening;

a first electrode disposed within said through opening of said insulating member and extending approximately over the full length thereof;

a second electrode attached to said plug body and spaced from the lower end of said first electrode;

first means, incorporated in said insulating member, for defining a first chamber to which the lower end of said first electrode is exposed, said first chamber being adapted to accommodate initial combustion of an air/fuel mixture introduced thereinto and to produce a plasma gas for primary combustion of the engine;

second means for defining between said plug body and said insulating member a second chamber for heating the air/fuel mixture introduced into said first chamber by introducing thereinto combustion gases from said engine, said second means blocking communication between said first and second chambers and being adapted to transmit the heat of the combustion gases to the air/fuel mixture in said first chamber.

7. A plasma ignition plug for an internal combustion engine comprising:

a plug body;

an electrical insulating member disposed within said plug body and extending coaxially therethrough;

a first electrode extending along the longitudinal axis of said insulating member;

a second electrode attached to the lower end of said plug body and at a location spaced from the lower end of said first electrode, said second electrode being adapted to produce a potential difference between said first electrode for sparking;

first means for defining a first chamber to which an air/fuel mixture is introduced, said first means being adapted to effect initial combustion within said first chamber to produce a plasma gas therein and to discharge said plasma gas from said first chamber with an electromagnetic force produced between said first and second electrodes; and second means for defining a second chamber to which heated gas is introduced for heating said air/fuel mixture in said first chamber in order to ensure the initial combustion therein.

8. A plasma ignition plug for an internal combustion engine comprising:

a plug body, an insulating member disposed within said plug body and extending co-axially with said plug body, said insulating member defining a first chamber at the lower end thereof for receiving an air/fuel mixture;

a first electrode axially extending through said insulating member; and a second electrode attached to said plug body in a position opposite to said first electrode, said second electrode being co-related with said first electrode for effecting initial combustion in said first chamber and for producing an electromagnetic boosting force for discharging the plasma gas produced by initial combustion of the air/fuel mixture in said first chamber from said first chamber.

9. An ignition plug for an internal combustion engine, comprising:

an electrically conductive plug body having a cylindrical lower portion which is externally threaded for engagement with an engine cylinder head;

an insulating member received within the lower portion of said plug body and entending upwardly therefrom, the lower portion of said insulating member being shaped to define a plasma generating chamber;

a first electrode extending through said insulating member along the longitudinal axis thereof, with the lower end of said first electrode protruding into said plasma generating chamber;

a second electrode spaced from said first electrode and extending from said plug body externally across said plasma generating chamber, said second electrode cooperating with said plug body and said insulating member to define an annular chamber surrounding said plasma generating chamber; and first and second operating sections in said second electrode communicating respectively with said plasma generating chamber and said annular chamber.

* * * * *